US006551030B1

(12) United States Patent
Curry

(10) Patent No.: US 6,551,030 B1
(45) Date of Patent: Apr. 22, 2003

(54) TUBULAR PILE CONNECTION SYSTEM

(75) Inventor: Peter James Curry, Epsom (GB)

(73) Assignee: Britannia Engineering Consultancy Ltd., Surrey (GB)

( * ) Notice: Subject to any disclaimer, the term of this patent is extended or adjusted under 35 U.S.C. 154(b) by 0 days.

(21) Appl. No.: 09/555,974

(22) PCT Filed: Dec. 4, 1998

(86) PCT No.: PCT/GB98/03631

§ 371 (c)(1),
(2), (4) Date: Jun. 6, 2000

(87) PCT Pub. No.: WO99/29967

PCT Pub. Date: Jun. 17, 1999

(30) Foreign Application Priority Data

Dec. 5, 1997 (GB) ..... 9725907
Aug. 19, 1998 (GB) ..... 9818112

(51) Int. Cl.[7] ..... E02D 5/22; F16L 39/00

(52) U.S. Cl. ..... 405/251; 405/231; 405/244; 285/319; 285/322; 403/321; 403/375

(58) Field of Search ..... 405/225, 227, 405/228, 231, 233, 244, 250, 251; 166/242.6, 242.7, 214, 215; 285/315, 317, 319, 322, 123.9, 404, 913; 403/109.1, 109.5, 321, 325, 326, 375, 377

(56) References Cited

U.S. PATENT DOCUMENTS 3,768,562 A * 10/1973 Baker ..... 166/289
3,912,009 A 10/1975 Davis, Jr.
4,052,861 A * 10/1977 Malone et al. ..... 405/225 X
4,074,912 A * 2/1978 Van Bilderbeek et al. ..... 285/319 X
4,140,426 A * 2/1979 Knox ..... 405/225
4,176,717 A * 12/1979 Hix ..... 166/289
4,254,423 A 3/1981 Reinhard
4,372,704 A * 2/1983 Knox ..... 405/115
4,407,364 A * 10/1983 Johnston ..... 166/217
4,411,455 A * 10/1983 Schnatzmeyer ..... 285/316 X
4,422,805 A * 12/1983 Sweatman ..... 405/227 X
4,433,859 A * 2/1984 Driver et al. ..... 285/317 X
4,439,068 A * 3/1984 Poklandnik ..... 285/315 X (List continued on next page.)

FOREIGN PATENT DOCUMENTS

DE 3825866 * 2/1990 ..... 285/319
FR 2320450 3/1976
FR 2496830 12/1980
GB 1296930 4/1970
GB 1422667 11/1973
GB 2241525 * 9/1991 ..... 405/231
GB 2332256 8/1998

*Primary Examiner*—Jong-Suk (James) Lee

(57) ABSTRACT

An arrangement for connecting tubular articles, particularly piles and pile sleeves, in which a first tube (4) fits into a second tube (2), the first tube having a first circumferential recess (10) and a second circumferential recess (12), and the second tube has a first set of latches (8) and a second set of latches (8') which are resiliently biased to engage in the first and second recesses respectively. When the latches and the recesses are mutually engaged, axial movement is prevented by abutments in the recesses and the latches by one set of latches in one direction and the other set of latches in the opposite axial direction. Latching engagement is only possible when the first set of latches is opposite the first recess and the second set opposite the second recess. This ensures positive connection and the use of preferred elements (30) which extend from one set of latches through the outer casing of the second tube. A mechanism can be provided to readily unlatch the tubes. In another arrangement, a similar unlatching arrangement is used, comprising a set of latches (118) which locate in a recess (117') bounded by a circumferential abutment surface (117). The latches (118) are retracted by bolts (123) which extend to the outside of tube (110).

14 Claims, 8 Drawing Sheets

U.S. PATENT DOCUMENTS 4,465,133 A * 8/1984 Bridges ..... 166/214 X
4,468,055 A * 8/1984 Reimert ..... 285/321 X
4,477,104 A 10/1984 Akkerman
4,526,406 A * 7/1985 Nelson ..... 285/315 X
4,618,288 A 10/1986 Daigle
4,721,416 A * 1/1988 Gracia ..... 405/227
4,730,851 A * 3/1988 Watts ..... 285/317 X
4,867,612 A * 9/1989 Bassett ..... 405/227
4,902,045 A * 2/1990 McGugan et al. ..... 285/322 X
5,904,447 A * 5/1999 Sutton et al. ..... 405/263

* cited by examiner

FIG. 10
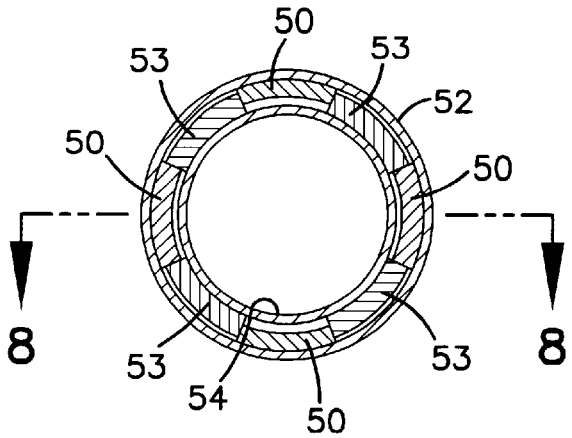
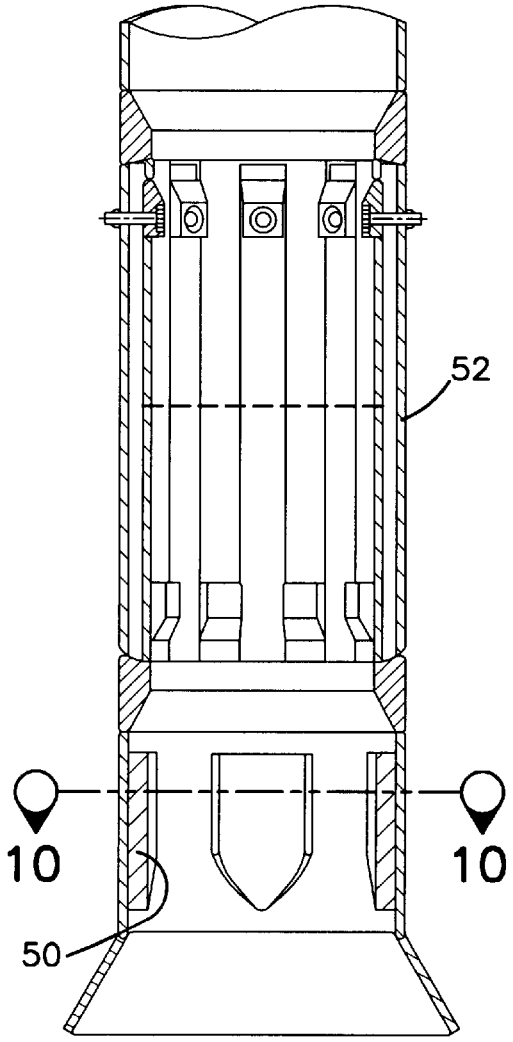
FIG. 8
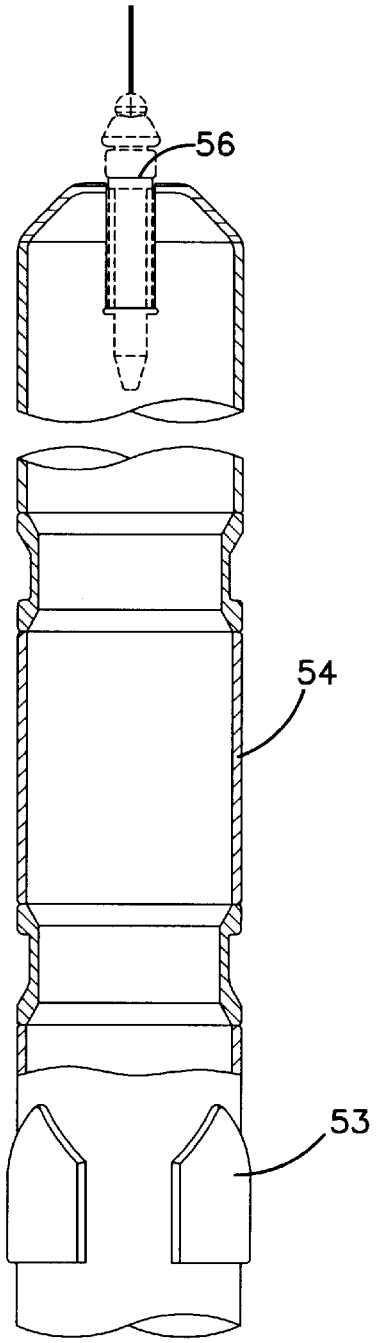
FIG. 9

TUBULAR PILE CONNECTION SYSTEM

FIELD OF THE INVENTION

The present invention relates to an arrangement for connecting tubular articles, particularly piles and pile sleeves, together.

BACKGROUND OF THE INVENTION

In offshore applications, there are several ways of connecting piles to pile sleeves, such as providing an annular space between the pile and pile sleeve and then when assembly is required, grouting the annular space. In another arrangement, the pile is swaged into prepared grooves provided in the pile sleeve, and in yet a further arrangement, a large and heavy pin is inserted through the pile and pile sleeve. When used underwater, the connection is difficult and may well involve the use of divers.

SUMMARY OF THE INVENTION

Accordingly, a tubular connection according to the invention comprises a first tube and a second tube, one having a part insertable into the other in an axial direction, the first tube having a first circumferential recess and a second circumferential recess, the second tube having a first set of resiliently biased latching means latchingly engageable in the first recess and a second set of resiliently biased latching means latchingly engageable in the second recess and corresponding abutments on the first recess and first set so that when mutually engaged axial movement is prevented in a first said axial direction and when the second recess and second set are mutually engaged axial movement is prevented in a second said axial direction opposite the first direction.

Engagement between the tubes preventing relative axial movement is achieved by sliding an end portion of one tube of greater internal size than the other (the tubes may be of circular or rectilinear cross section) over the end of the other tube so that as the first set of latching means which is nearest the end of the first tube meets the recess of the other tube nearest its end they do not engage latchingly, latching engagement being only possible when the first set of latching means is opposite to the first recess and second set opposite the second recess.

Means are preferably provided to unlatch the latching means from outside the tube connection. Such a means is a protrusion from each latching means to the outside which can be urged outwardly against the bias by suitably shaped ring around the connection.

A tubular connection according to another aspect of the invention comprises a first tube and a second tube, the first tube having a circumferential recess biased to latchingly engage with the recess by inward movement, the latching means being provided with means to cause outward unlatching movement so that by relative axial movement of the tubes they can be disconnected.

The provision of disconnection means when used underwater provides a simple way of disconnecting without the use of divers.

BRIEF DESCRIPTION OF THE DRAWINGS

Embodiments of the invention will now be described by way of example with reference to the accompanying drawings in which:

FIG. 8 is a cross section of a second embodiment of the invention taken on line 8—8 of FIG. 10, FIG. 9 is a part cross section of one tubular member for the connection of FIG. 8, FIG. 10 is a cross section of FIG. 8 taken on line 10—10.

DESCRIPTION OF THE PREFERRED EMBODIMENTS

Figure 6:
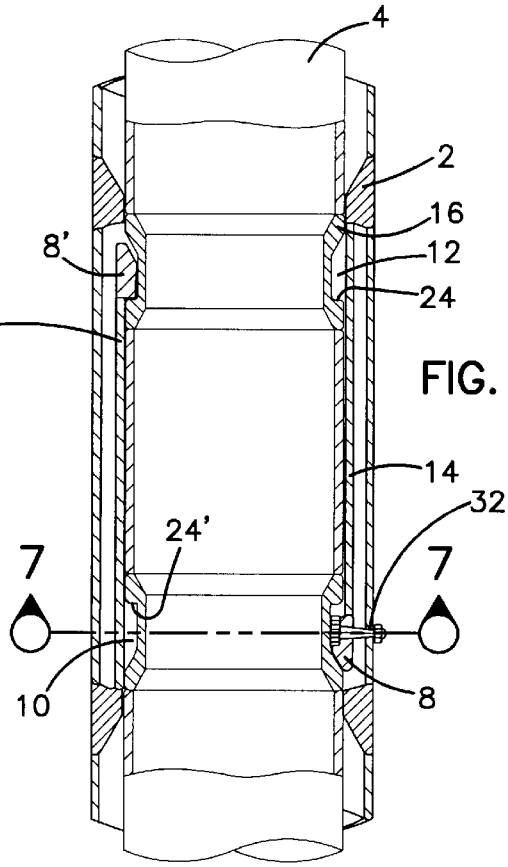
FIG. 6 is a similar cross section to FIG. 3 showing the connection of FIG. 1 at a fourth and final engaging stage.

In the first embodiment shown in FIGS. 1 to 7, a first tube 2 of circular cross section is arranged to fit over a second tube 4 to form a connection as shown in FIG. 6. The connection comprises two sets 5 and 6 of latching means 8 and 8', the first of which fits in a latchingly engageable manner into a first recess 10 whilst the second set fits into a second circumferential recess 12.

Figure 1:
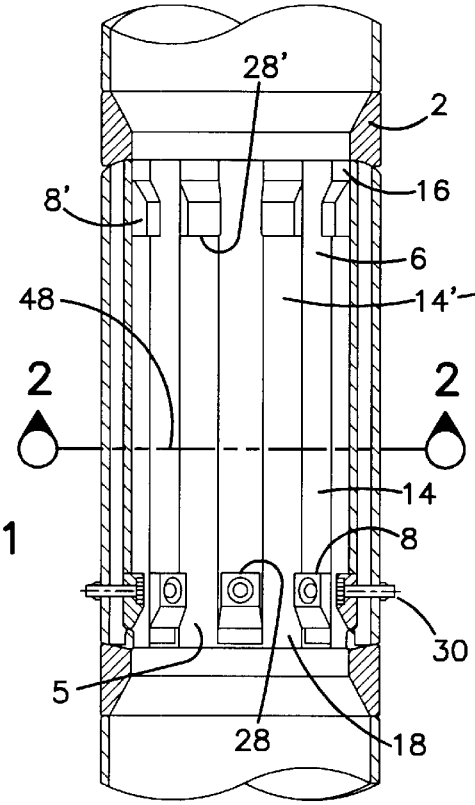
FIG. 1 is a cross section taken on line 1—1 of FIG. 2 of a tubular connection according to he invention.
Figure 2:
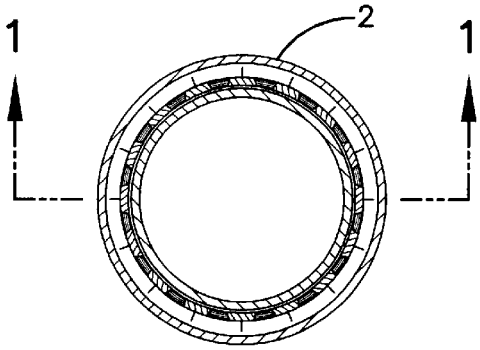
FIG. 2 is a cross section of FIG. 1 taken on line 2—2.
Figure 7:
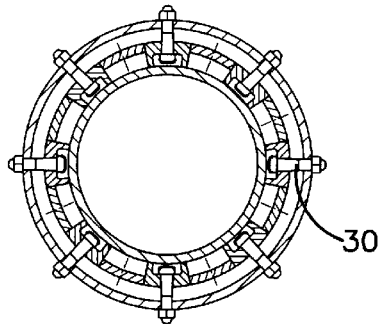
FIG. 7 is a cross section taken on line 7—7 of FIG. 6.

As will be seen from FIG. 1, each set of latching means comprises eight latches 8 and 8'. Each latching member is supported on a resiliently flexible finger 14 and 14'. The fingers are intercollated so that, as seen in FIG. 1, the downwardly extending fingers 14 which are fixed at their upper end 16 lie adjacent to the upwardly extending fingers 14' which are fixed at their lower end 18. Both sets of fingers 14 and 14' are pinned together for partial rotation at their mid point, or other intermediate position, that is, at the level of the cross section 2—2 on which FIG. 2 is taken. By this means, outward pressure on latches 8' causes latches 8 to move outwards and vice versa.

Figure 5:
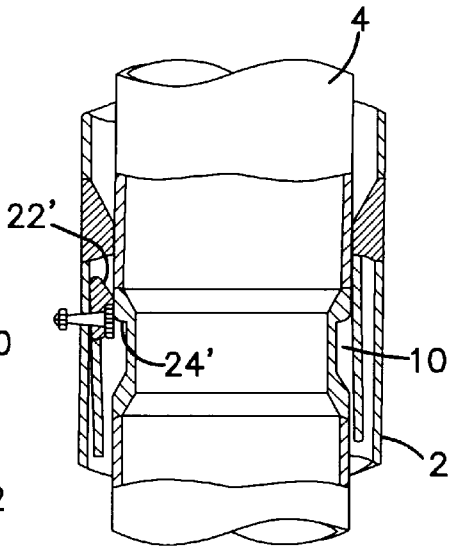
FIG. 5 is a similar cross section to FIG. 3 showing the connection of FIG. 1 at a third engaging stage.
Figure 4:
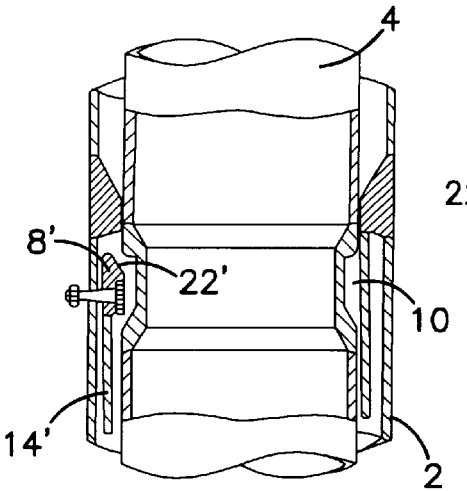
FIG. 4 is a similar cross section to FIG. 3 showing the connection of FIG. 1 at a second engaging stage.
Figure 3:
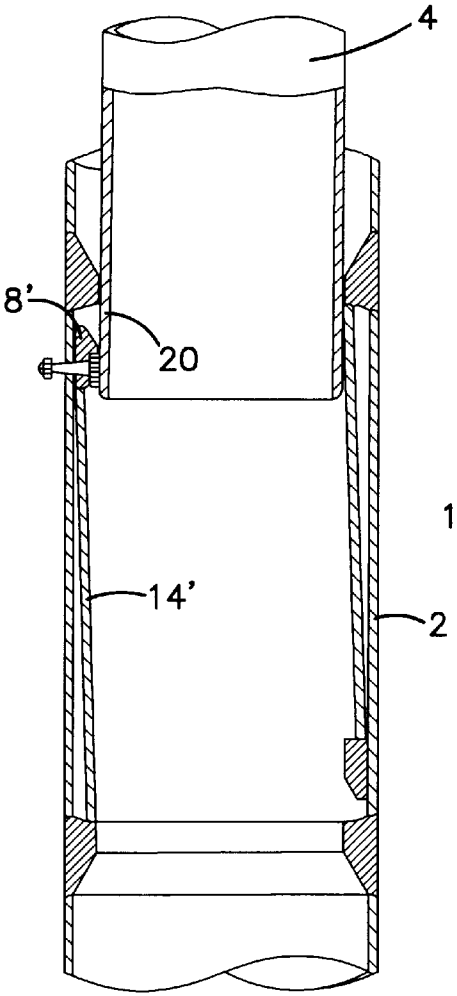
FIG. 3 is a cross section taken on line 1—1 of FIG. 2 of the connection of FIG. 1 at a first engaging stage.

On first engagement between tube 2 and tube 4, as shown in FIG. 3, latches 8' of the second set 6 are forced outwardly by the end portion 20 of tube 4 until recess 10 is level with set 6 of latches 8'. The latches then tend under the bias of finger 14' to enter recess 10. This is shown in FIG. 4. As the tube further intrudes into tube 2, a chamfered face 22' on each latch 8' causes latches 8' to ride outwardly from the rectilinear abutment face 24' of recess 10. This is shown in FIG. 5. As tube 4 continues into tube 2, recess 10 comes opposite set 5 of latches 8 and at the same time, recess 12 comes opposite to latches 8' of set 6. Both sets 5 and 6 of the latches are then able to engage in the recesses 10 and 12 so that the rectilinear abutment faces 24' and 24 of recesses 10 and 12 latchingly engage with rectilinear abutment faces 28 and 28' on latches 8 and 8'. Tube 4 is then latched into place in tube 2 so that any axial movement of tube 4 in either direction is transferred directly to tube 2.

Whereas the tubes are shown as having a circular cross section, they can equally be of rectangular cross section.

Figure 13:
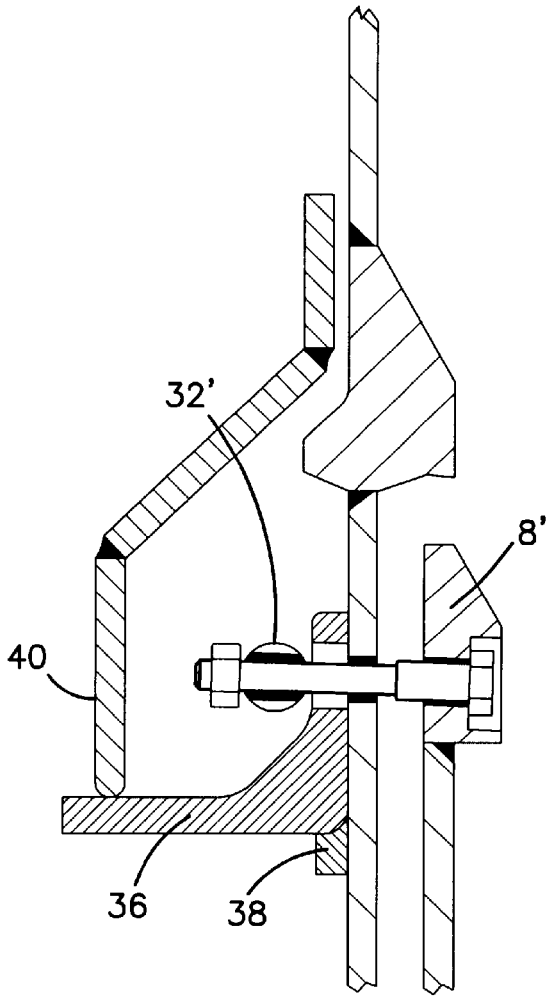
FIGS. 13 and 14 are similar cross sections of a modification to the first embodiment of FIG. 1 showing disengaging arrangements for the tubular connection of the invention.
Figure 14:
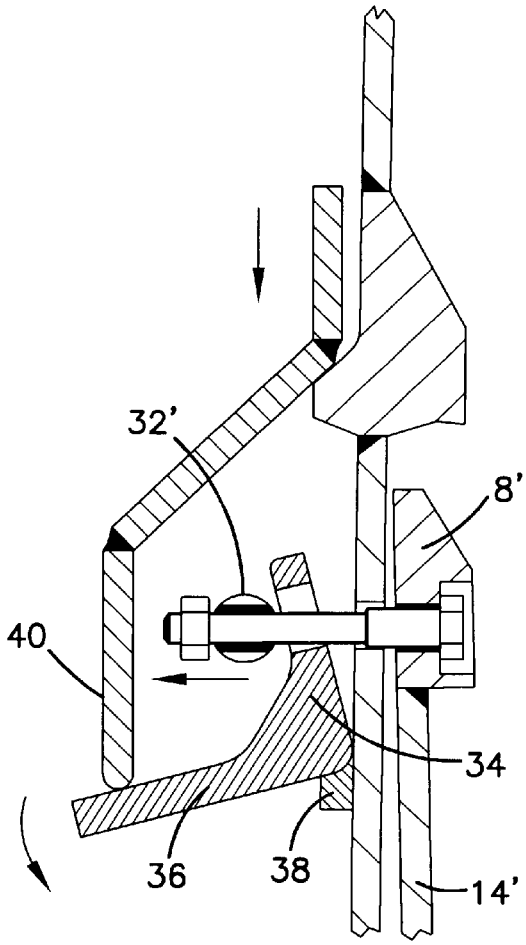

Each latch 8 or 8' has a guiding bolt 30 which is mounted for axial movement in radial openings 32 in tube 2. In a modification of this embodiment, as shown in FIGS. 13 and 14, the guiding bolts 32' for latches 8' have lengthened shanks which engage in arms 34 of cranked members 36 which pivot on abutments 38. In order to release the latches, and thus disengage the connection, a ring 40 surrounding the tube is lowered so as to cause cranks 36 to pivot about abutments 38 and so cause bolts 32' to move outwardly and hence latches 8' outwardly. Because the fingers 14' and latches 8' are fixed at points 48 to the fingers 14 of latches 8, latches 8 also move outwardly. Hence both sets 5 and 6 of the latches disengage from recesses 10 and 12. Tube 4 can then be pulled out of tube 2.

It will be appreciated that because the fingers 14 and 14' are interconnected only one set of bolts 32 on either set 5 or set 6 but not both is required.

FIGS. 8, 9 and 10 show a second embodiment in which any torque between the tubes which might damage the fingers 14 and 14' is relieved by means of pointed blocks 50 on first tube 52 which engage on corresponding pointed blocks 53 on second tube 54. These are clearly shown separately in FIGS. 8 and 9 and mated together in FIG. 10. Engagement between the tubes may be assisted by a proprietary guidance system 56.

Figure 11:
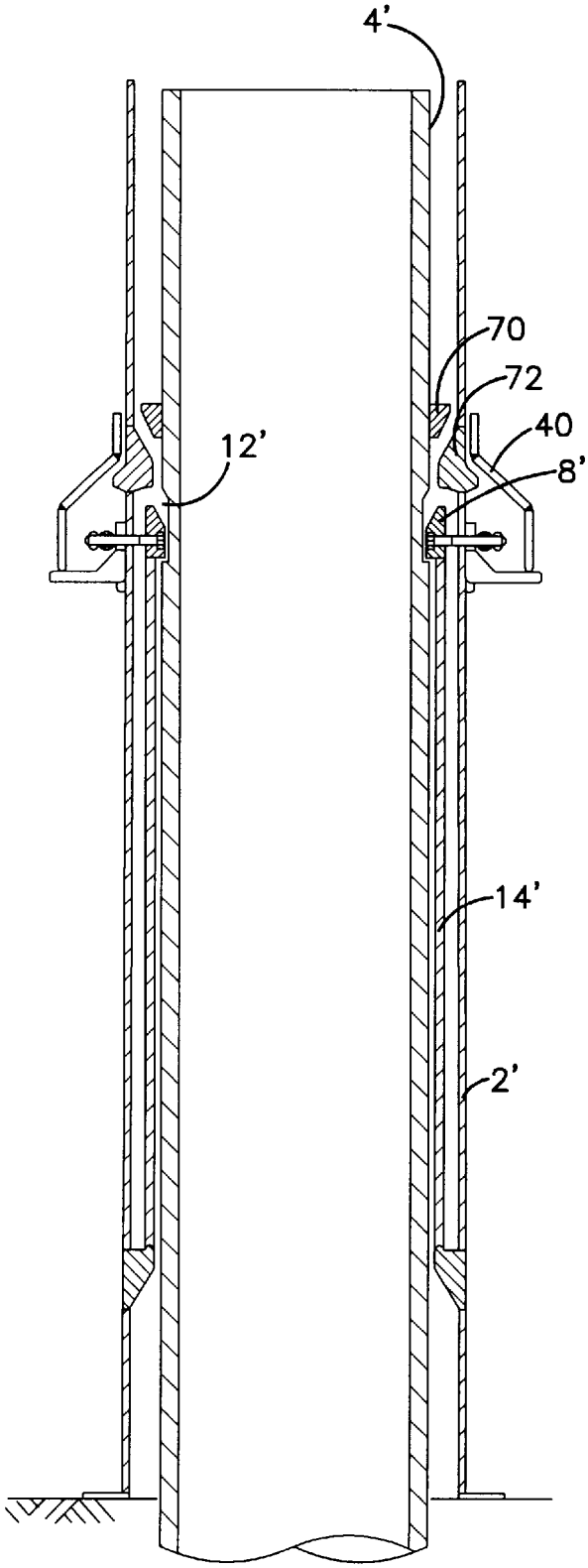
FIG. 11 is an axial cross section of a third embodiment of the invention.

In a third embodiment, shown in FIG. 11, a single set of upwardly extending fingers 14' with latches 8' engage in a single recess 12'. The latches 8' have the same directional effect for acting in tension as the arrangements in FIG. 1. However, in order to enable the connection to act so as to counter movement in both directions, an external collar 70 on tube 4' engages with an internal ring 72 on tube 2'.

Figure 12:
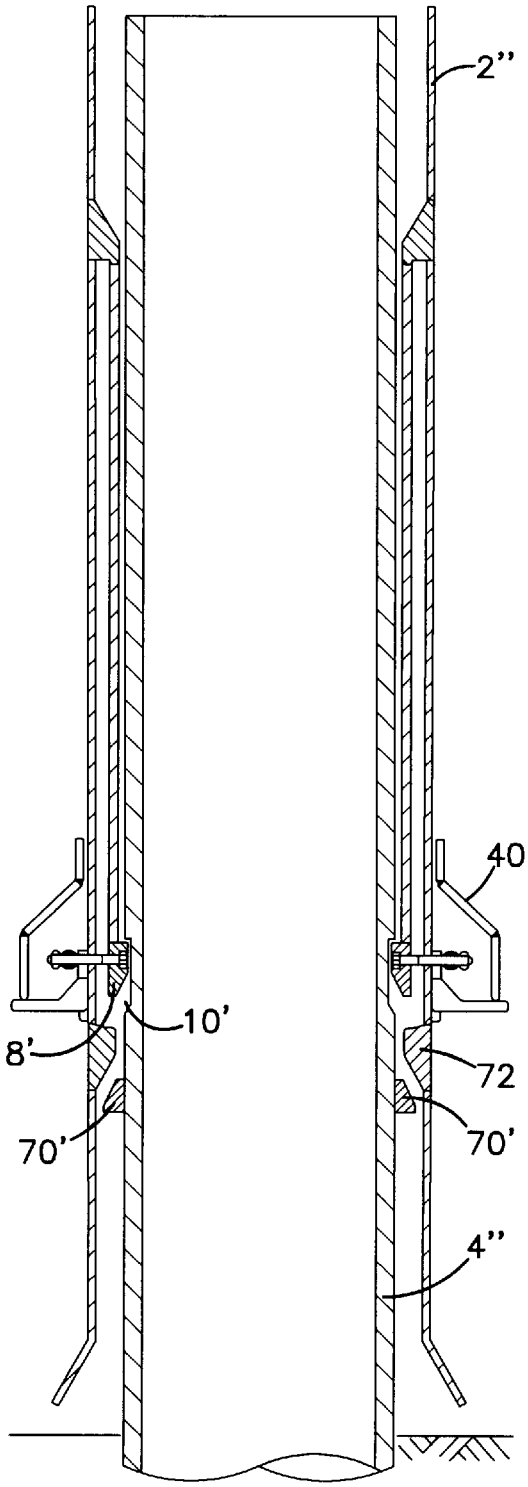
FIG. 12 is an axial cross section of a fourth embodiment of the invention.

In a fourth embodiment, shown in FIG. 12, the reverse arrangement of FIG. 11 is shown with collar 70' on tube 4" acting with recess 10' to provide bidirectional latching.

An energy absorbing collar may be incorporated into the arrangement. This is shown in the embodiment of FIGS. 15 to 19 and comprises a ring 75 welded to a segmented liner 76 which is bonded to an elastomeric collar 77 formed for instance of polychloroperene. The elastomeric collar 77 is in turn bonded to the upper pile tube 79. The ring 75 is not attached to the pile tube 79, being free to move axially independently of the pile tube 79.

The energy absorbing collar arrangement of this latter embodiment is intended to absorb energy by deformation of the elastomeric liner 77 in the event that the pile is inadvertently overdriven. This occurs when the pile hammer operator allows the pile to penetrate beyond the target penetration. Before the lower pile groove abutment face 80 can be driven against the abutment face 81 of the latch or spring head 82, the ring 75 will engage on an upper support ring 84 which has a chamfered surface corresponding to the chamfered surface of ring 75. Further driving of the pile will cause ring 75 to react with the segmented liner 76, causing the elastomeric collar 77 to be deformed in shear. A gap 85 between the ring 75 and collar 77 enables the free deformation of the collar without the slip ring 75 bearing directly on to the collar 77. The ring 84 contacts ring 75 before abutment faces 80 and 81 come into contact. This ensures that energy applied to tube 79 will be absorbed by a combination of both the collar shear deformation and the pile overcoming soil resistance to penetration. Furthermore, the avoidance of stress on the spring head 82 avoids damage to these components.

Figures 16, 17:
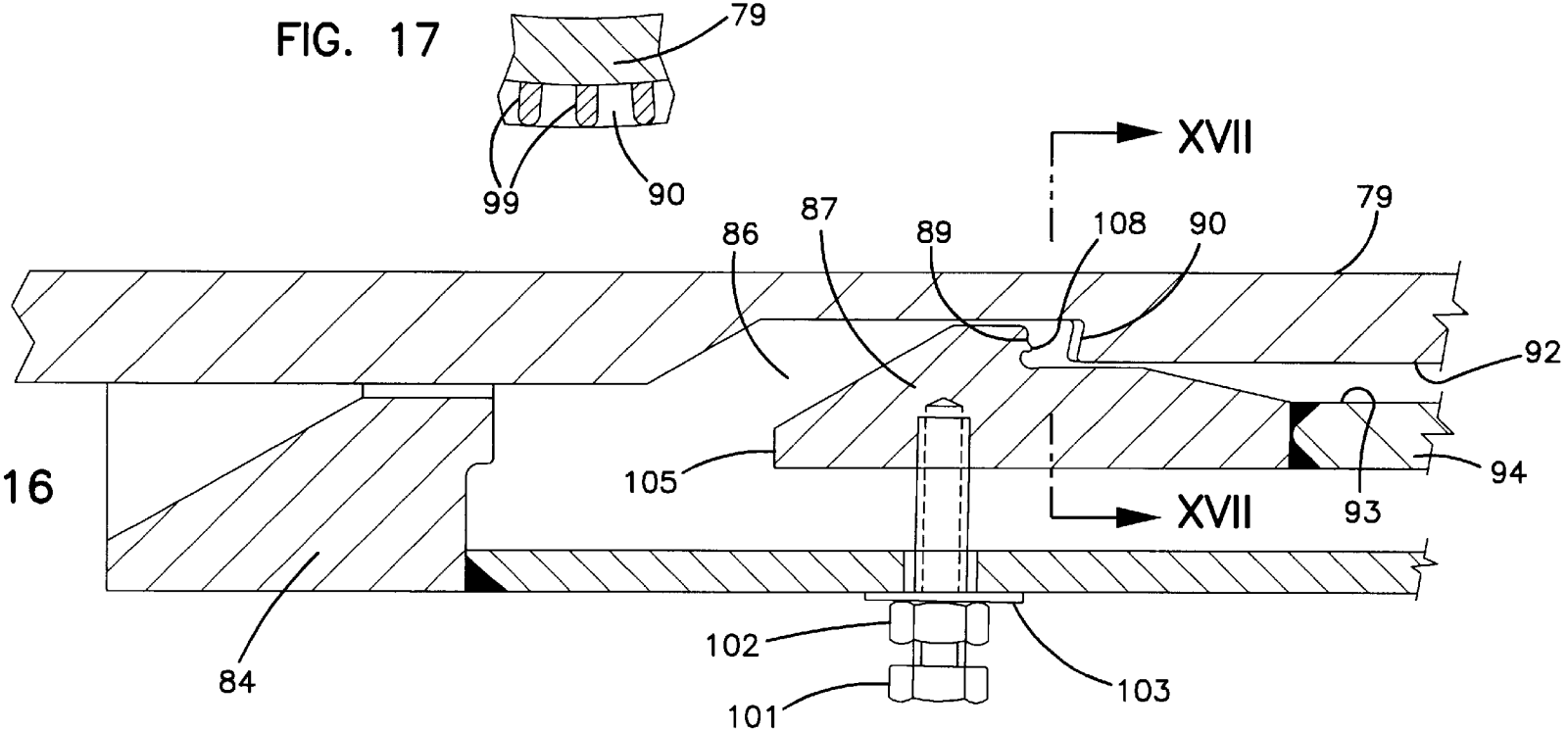
FIG. 16 is a longitudinal cross section of one of the latching recesses of the embodiment of FIG. 15.
FIG. 17 is a transverse cross section of the recess of FIG. 16 taken on XVII.

In FIG. 16, the upper pile groove 86 is shown, and in broken lines, an upper spring head 87 is also shown. The abutment faces 89 and 90 of respectively the spring head and pile groove are inclined to the horizontal to ensure better engagement.

Because of the necessary gap between the outer surface 92 of the upper pile and the inner surface 93 of the springs 94 and 95, it is possible for the upper pile tube 79 to be inclined slightly to the lower pile tube 97. As a result of this, it would be possible to have an uneven distribution of loading to each of the spring heads 82 and possibly 87. To assist in avoiding this, the spring head abutment face 89 of spring head 87 and also spring head 82 are each provided with a nib 108 which, when the faces 89 and 90 come into engagement, bears against radial beads 99 on face 90, causing localised bearing deformation. The beads 99 are welded on to the face 90, using a soft material such as soft iron or possibly copper or a nickel alloy.

Figure 19:
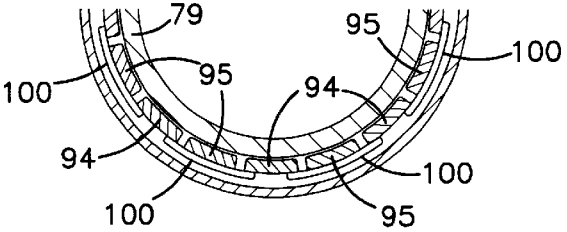
FIG. 19 is a cross section of a second tube of FIG. 15 taken on XIX.
Figure 18:
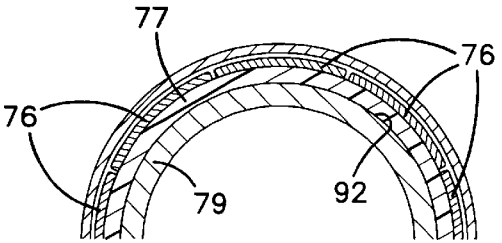
FIG. 18 is a cross section of half a first tube of FIG. 15 taken on XVIII.
Figure 15:
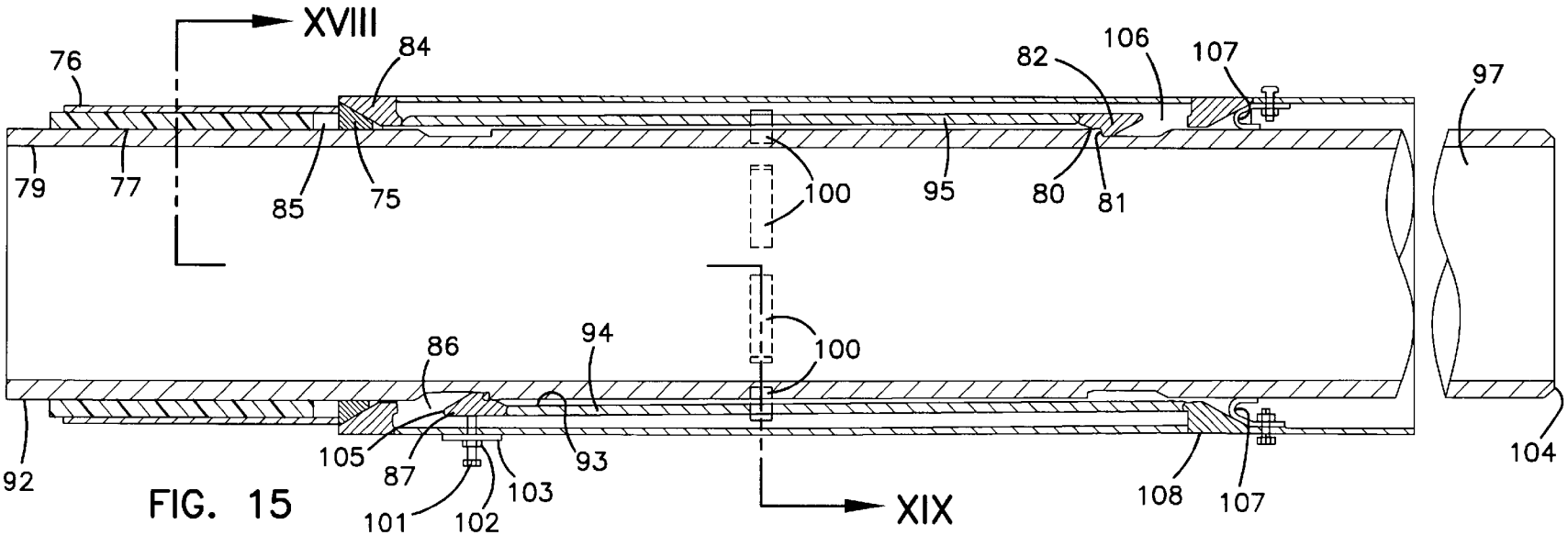
FIG. 15 is a similar longitudinal cross section to FIG. 6 showing a fifth embodiment of the invention.

In order to ensure that outward movement of spring heads 87 results in a consequential outward movement of spring heads 82 to facilitate interlocking and unlocking of the tubes 79 and 97, the springs 94 which terminate with upper spring heads 87 are arranged to push out springs 95, having spring heads 82 by means of arcuate plates 100 welded to springs 95 in such a way as to overlap on each side the edges of springs 94. This is best shown in FIG. 19. In order to balance the outward movement of spring heads 87 and spring heads 82, the arcuate plates 100 are located nearer heads 87 than heads 82, as may be seen in FIG. 15.

In order to unlatch the pile tubes 79 and 97, retractor bolts 101 are provided which locate freely in radial holes in tube 97 but which are threadingly connected to the heads 87. Each bolt 101 has an outer nut 102 to which is welded a large washer 103. The position of the spring head can be adjusted radially so as to avoid the lower edge 104 of the pile hitting the upper nose 105 of any of the upper spring heads during connection of the two pile tubes. The washer 103 also provides a visual indication for a remote underwater camera as to when the retractor bolts attached to the spring heads move radially inward to engage in groove 86. This is particularly useful when coupling piles underwater where any indication has to be easily visual to a remote camera.

To prevent soil or detritus from entering the annular space 106 between tubes 79 and 97, which could interfere with the operation of springs 94 and 95, an elastomeric seal 107 is provided on the inner side of a ring 108 on the upper end of lower pile tube 97 and seals against the outer face of tube 79. It will be appreciated that the lower pile tube 97 fills with soil as it is driven into the ground or sea bottom.

The operation of the embodiment shown in FIGS. 15 to 19 is similar to that shown in FIGS. 1 to 7. It will be appreciated that retractor bolts can be provided on the lower spring heads 82. In this case additional arcuate plates 100 would be welded to springs 94 to ensure consequential movement of upper spring heads 87. It is also possible to use other methods of connecting the springs 94 and 95 together. For instance, coiled springs acting on the inner and outer surfaces of both springs 94 and 95 could result in suitable functional connection although these might not be so reliable as the arcuate plate construction shown in FIG. 19.

Figure 20:
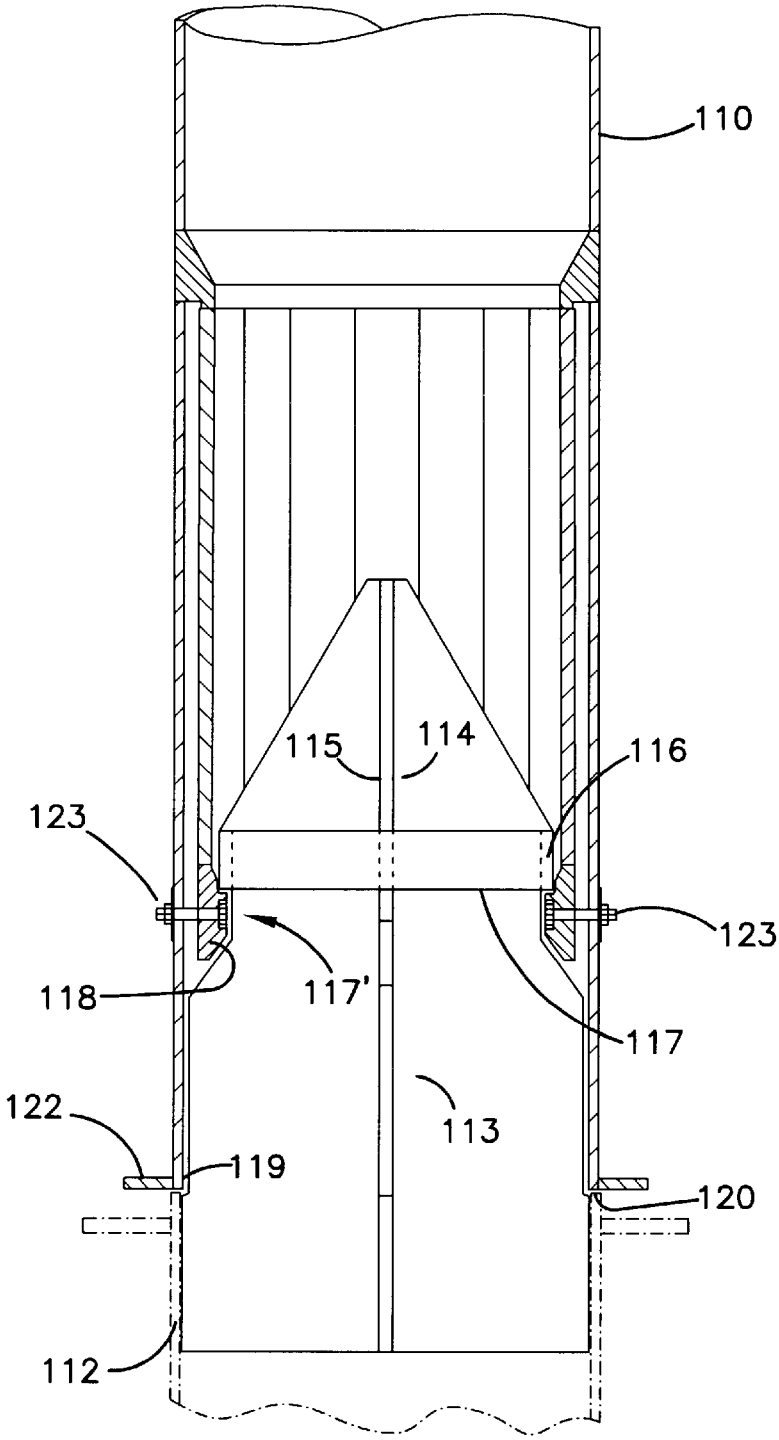
FIG. 20 is a partial longitudinal cross section of a further embodiment of the invention.

In FIG. 20, an arrangement similar to FIG. 12 is shown, in which an upper tube 110 is to be fitted to a lower tube 112, having a cruciform head 113. The cruciform head 113 is formed from two upwardly tapering plates 114 and 115 interlocked to provide a virtually conical mating head to assist location of upper tube 110. Plates 114 and 115 are mounted to a collar 116 having a lower abutment surface 117 to which spring heads 118 engage to lock the pile tubes together. Abutment between tubes is here provided by end surfaces 119 and 120 of tubes 112 and 110 respectively. A flange plate 122 is welded to the lower end of tube 110 adjacent surface 120 in order to strengthen the tube 110 at its outer and lower edge. Retractor bolts 123 are fixed to the spring heads 118 as before or by the simple means as shown with the bolt heads in the spring heads and the nuts bearing on the outside of tube 110.

The connection arrangement of the invention is primarily intended for subsea surface piling but may well have surface and shore applications. The invention is useful for connecting piles and pile sleeves together but also can be used for connecting one pile axially to another.

What is claimed is:

1. A tubular connection comprising a first tube and a second tube, one of the tubes having a part insertable into the other tube in an axial direction, the first tube having a first circumferential recess and a second circumferential recess, and the second tube having a first set of resilient biased latches latchingly engageable in the first recess and a second set of resiliently biased latches latchingly engageable in the second recess; and further comprising corresponding abutments on the first and second recess and the first and second set, respectively, so that when the first recess and first set are mutually engaged axial movement is prevented in a first said axial direction and when the second recess and second set are mutually engaged axial movement is prevented in a second said axial direction opposite the first direction; and wherein at least one of the sets of latches is provided with an unlatching mechanism that extends through the outer one of said tubes and is connected to a retractor mechanism.

2. The connection as claimed in claim 1, wherein the first and second tubes each have interacting primary abutment surfaces separate from the first and second set of latches, and the abutment surfaces are arranged so as to limit movement in the direction of insertion.

3. The connection as claimed in claim 2, wherein one said primary abutment surface is provided on a ring attached to one said tube by a resilient interconnecting member.

4. The connection as claimed in claim 1, wherein each of the latches of the first set extends in one said axial direction and each of the latches of the second set extends in the other said axial direction opposite the first set.

5. The connection as claimed in claim 4, wherein the individual latches of the first set extend between the individual latches of the second set.

6. The connection as claimed in claim 1, wherein the individual latches of the first set are interconnected to the individual latches of the second set so that movement of any or all of the latches of the first set radially inwards or outwards causes similar movement of the latches of the second set.

7. The connection as claimed in claim 1, wherein the individual latches of the first set are arranged to bear on the adjacent individual latches of the second set so that movement of said individual latches of the first set causes similar movement of the adjacent individual latches of the second set.

8. A pair of piles having a tubular connection as claimed in claim 1.

9. A tubular connection comprising a first tube and a second tube, the first tube and second tube at least partially interfitting, the first tube having a circumferential recess, and the second tube having a set of latches biased to latchingly engage with the recess by inward movement; the latches including a mechanism to cause radially outward unlatching movement thereof so that by relative axial movement of the tubes they can be disconnected, and the mechanism extends through the outer one of said tubes and is connected to a retractor mechanism.

10. The tubular connection as claimed in claim 9, wherein each latch comprises a radially movable latching head fixed to a resilient longitudinal element at one end of the element, the other end of the element being fixed to one of the tubes.

11. The tubular connection as claimed in claim 10, wherein the latching head has a chamfered outer extremity so that on insertion of one said tube into the other said tube contact with the head causes radially outward movement of the head.

12. The tubular connection as claimed in claim 10, wherein said mechanism includes a mechanism to retract each individual latching head simultaneously.

13. The tubular connection as claimed in claim 9, further including structure to prevent one of the tubes from rotating about its axis relative to the other one of the tubs on mutual interengagement with the other tube.

14. A pair of piles having a tubular connection as claimed in claim 9.

* * * * *